US005693290A

United States Patent [19]

Kessler et al.

[11] Patent Number: 5,693,290

[45] Date of Patent: Dec. 2, 1997

[54] INHIBITION OF CORROSION IN AQUEOUS SYSTEMS

[75] Inventors: Stephen M. Kessler, Fairless Hills; Roger C. May, Glenside, both of Pa.

[73] Assignee: BetzDearborn Inc., Trevose, Pa.

[21] Appl. No.: 638,632

[22] Filed: Apr. 26, 1996

[51] Int. Cl.[6] ..... C23F 11/167

[52] U.S. Cl. ..... 422/15; 422/14; 252/389.22

[58] Field of Search ..... 422/14, 15; 252/389.22

[56] References Cited

U.S. PATENT DOCUMENTS 4,798,675 1/1989 Lipinski et al. ..... 422/15

*Primary Examiner*—Timothy McMahon

*Attorney, Agent, or Firm*—Alexander D. Ricci; Richard A. Paikoff

[57] ABSTRACT

A method and composition for controlling corrosion of metals in contact with an aqueous system is disclosed, which method includes introducing into the aqueous system a sufficient amount of a substantially zinc-free treatment comprising a phosphate compound, and glucoheptonic acid or a water soluble salt thereof.

15 Claims, No Drawings

INHIBITION OF CORROSION IN AQUEOUS SYSTEMS

BACKGROUND OF THE INVENTION

In industrial cooling systems, water such as from rivers, lakes, ponds, etc. is employed as the cooling media for both contact and non-contact cooling applications. The pulp and paper industry is one manufacturing segment which utilizes large quantities of water for non-contact cooling purposes. These waters are typically referred to as mill supply waters and are primarily those for which this invention was designed. Mill supply waters can also be used as gland water for industrial equipment or as wash water in the paper process. Mill supply applications, for instance, typically use water in a once through mode without diverting the water to a tower for evaporation. Effective mill supply corrosion control programs are typically cost prohibitive due to the large volumes of water which must be treated. Current treatments are only marginally effective and contain varying combinations of zinc, inorganic phosphate, and/or polymer at significantly reduced inhibitor dosages.

In cooling systems, corrosion causes several problems. The obvious is the failure of equipment, resulting in replacement costs and plant downtime. Also, decreased plant efficiency occurs due to the loss of heat transfer. In addition, the accumulation of corrosion products causes heat exchanger fouling, resulting in the loss of heat transfer.

Ferrous-based metals, e.g., iron metal and metal alloys containing iron (mild steel), are routinely used in the construction of cooling systems due to their low cost and availability. As the system water passes over or through the ferrous-based metal containing devices, they are subjected to corrosion processes. Corrosion inhibitors are generally added as part of a water treatment program in cooling systems to prevent and inhibit the corrosion of ferrous-based metal containing devices.

There exists a need for a more environmentally acceptable corrosion inhibitor of metals, e.g., ferrous-based metals in contact with aqueous systems. In particular, there is a need for a non-zinc, low phosphorous containing organic corrosion inhibitor.

Restrictions with regard to phosphate and zinc have become ever more severe for industries which discharge to local rivers and streams. Both of these materials are known mild steel corrosion inhibitors and are utilized extensively in mill supply applications, in particular. They are typically used in combination with a polymer for deposit control. The mill supply market, for instance, includes systems which are commonly once-through applications for mostly non-contact cooling processes. They usually involve large volumes of water. Consequently, only low dosages of treatment chemical are affordable resulting in marginal treatment performance at best.

Preventing the corrosion and scaling of industrial heat transfer equipment and associated transfer piping is essential to the efficient and economical operation of a cooling water system. Excessive corrosion of metallic surfaces can cause the premature failure of process equipment, necessitating downtime for the replacement or repair of the equipment. Additionally, the buildup of corrosion products on any heat transfer surface reduces efficiency, thereby limiting production or requiring downtime for cleaning.

Cooling systems that use a water's cooling capacity a single time are called once-through cooling systems. These systems use large volumes of water and typically discharge the once-through water directly to waste. Large volumes of water are necessary for even the smallest once-through systems; therefore, a plentiful water supply at a suitably low temperature is needed.

Once-through cooling water systems are identified by various names. For example, in the paper industry, most mills refer to their once-through cooling water as "mill supply". The power industry often refers to a once-through cooling network as the "service water" system. The chemical and hydrocarbon processing industries typically use the descriptive "once-though" terminology for their systems.

DETAILED DESCRIPTION OF THE INVENTION

The present invention provides an effective method and compositions for inhibiting and controlling corrosion of metals, particularly ferrous-based metals in contact with aqueous systems.

It has been discovered that a treatment substantially free of zinc comprising a phosphate compound, glucoheptonic acid or a water soluble salt thereof and optionally, a water soluble polymeric dispersant has surprising activities for the inhibition of corrosion. Zinc is not intentionally added to the system; however, it is to be understood that trace amounts of zinc may be present in systems subject to treatment. The combined treatment may be added to the desired aqueous system in need of treatment in an amount of from about 0.1 to about 25 parts of the combined treatment to one million parts (by weight) of the aqueous medium. Preferably, about 0.1 to about 12.5 parts of the combined treatment per one million parts (by weight) of the aqueous medium is added.

Relative weight ratios (expressed as weight % on an active basis) of about 1–10 phosphate compound: 1–10 glucoheptonic acid:0.5–5 polymer would be expected to be effective in the present invention. It is most preferred that any commercial product embodying the invention comprises a weight ratio of about 1:1:0.5 phosphate compound:glucoheptonic acid:polymer. It is expected that higher levels of materials will also be effective.

The phosphate compound may be an orthophosphate compound, a polyphosphate compound or an organic phosphorous compound (e.g., a phosphonate or phosphate ester) which may revert to some degree in water to produce inorganic phosphate.

The water-soluble orthophosphate compounds which may be effective in the present invention include phosphoric acid, the sodium orthophosphates, the potassium orthophosphates, the lithium orthophosphates and ammonium orthophosphates, e.g., trisodium, monopotassium or di-ammonium orthophosphate. The water-soluble polyphosphate compounds which may be effective include the sodium polyphosphates, the potassium polyphosphates, the lithium polyphosphates and ammonium polyphosphates, e.g., tetrasodium pyrophosphate, sodium hexametaphosphate and potassium tripolyphosphate.

Tests were conducted utilizing a synthetic test water containing 20 ppm Ca, 10 ppm Mg, 25 ppm M-alkalinity (all as $CaCO_3$) and 0.7 ppm Mn at a pH of 7.0, a specific conductance of 200 umhos, and a bulk temperature of 80° F. Other test parameters included a water velocity of 1 ft/sec., a skin temperature of 120° F., and a retention time of 0.65 days. System metallurgy consisted of low carbon steel (LCS) and admiralty (ADM) coupons, a LCS heat transfer probe, and a LCS corrosion rate meter probe. Testing lasted three days. The surprising results were those which identified organic materials that were as effective as zinc at relatively low dosages under dynamic conditions. Typically, organic inhibitors must be applied at elevated levels to achieve mild steel corrosion performance equivalent to lower dosages of zinc. Results are shown in Table I. Note that in testing of the present invention, LCS heat transfer corrosion tests, conducted at temperatures in excess of about 130° F., were also carried out. Improved heat transfer corrosion control was observed in several instances. Note that differing results may have been obtained had, e.g., different amounts of materials been tested.

TABLE I

| Test Treatment** | Corrosion Rate* (mpy) | |
|---|---|---|
| Baseline testing | LCS | ADM |
| 1. Control | 21 | 2.1 |
| 2. 1 ppm pyrophosphate<br>0.5 ppm Sulfonic acrylic copolymer, an acrylic acid/allyl hydroxypropyl sulfonate ether (AA/AHPSE) copolymer, or Polymer A | 12 | 3.3 |
| 3. 1 ppm pyrophosphate<br>0.5 ppm Polymer A<br>0.25 ppm zinc | 7.5 | 2.1 |

| | Corrosion Rate* (mpy) | | LCS Heat Transfer |
|---|---|---|---|
| | LCS | ADM | Corrosion results |
| Effective Inhibitor Replacement:<br>1 ppm pyrophosphate<br>0.5 ppm Polymer A<br>1 ppm glucoheptonic acid | 5.9*** | 1.2*** | – |

+ lower corrosion than zinc-based treatment
– no improvement versus zinc-based treatment
*Differential corrosion rate determinations
**All treatment dosages are expressed as ppm active concentration
***Average corrosion rate determination of two tests
Polymer A: AA/AHPSE = 3/1 molar ratio, mw = 3,000
Note: Tetrapotassium pyrophosphate tested above As to the source of organic material, both an acid salt or an alkali metal salt are expected to be effective. For example, an acid salt of glucoheptonate (e.g., glucoheptonic acid) or other alkali metal salts thereof (e.g., sodium or potassium glucoheptonate) are all expected to be effective.

As shown by Test 3 in Table 1, a current zinc-based mill supply treatment (1 ppm pyrophosphate, 0.5 ppm Polymer A, 0.25 ppm zinc) provides only marginal corrosion protection with LCS and ADM rates of 7.5 mpy and 2.1 mpy, respectively. The inhibitor shown in Table I displayed enhanced efficacy over the baseline treatments.

The acrylic acid/allyl hydroxy propyl sulfonate ether copolymer employed, in the present invention comprises the structure:

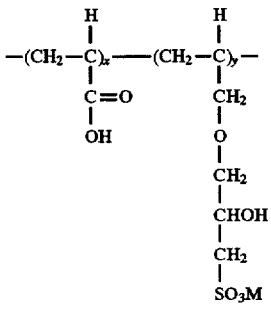

wherein M is a water soluble cation. This polymer is referred to as acrylic acid/allyl hydroxy propyl sulfonate ether (AA/AHPSE). The IUPAC nomenclature for AHPSE is 1-propane sulfonic acid, 2-hydroxy-3-(2-propenyl oxy)-mono sodium salt.

The polymer has a number average molecular weight (mw) in the range of 1,000 to 8,000. Preferably, mw will fall within the range of 2,000 and 4,000. The x:y molar ratio of the monomers may fall in the range of between 10:1 to 1:5. However, the preferred molar ratio is about 3:1.

Additional studies were also conducted with these materials under chlorinated conditions (otherwise, same test conditions as in Table I). This testing was conducted in order to 1) better differentiate treatment efficacy of the particular inhibitors under a more severe condition, and 2) determine that effect field chlorination would have on the efficacy of this particular technology. Earlier testing was repeated as outlined above but in the presence of a free chlorine residual, between about 0.2 and 0.4 ppm. This was accomplished by continuous feed of a sodium hypochlorite solution to the test apparatus. Test results are found in Table II.

TABLE II

| Test treatment** | Corrosion Rate* (mpy) | |
|---|---|---|
| Baseline Chlorination Testing | LCS | ADM |
| 1. 1 ppm pyrophosphate<br>0.5 ppm Polymer A | 65 | 3.9 |
| 2. 1 ppm pyrophosphate<br>0.5 ppm Polymer A<br>0.25 ppm zinc | 55 | 3.0 |

| | Corrosion Rate* (mpy) | | LCS Heat Transfer |
|---|---|---|---|
| | LCS | ADM | Corrosion results |
| Effective Inhibitor Replacement:<br>1 ppm pyrophosphate<br>0.5 ppm Polymer A<br>1 ppm glucoheptonic acid | 8.7*** | 3.0*** | + |

+ lower corrosion than zinc-based treatment
– no improvement versus zinc-based treatment
*Differential corrosion rate determinations
**All treatment dosages are expressed as ppm active concentration
***Average corrosion rate determination of two tests
Note: Tetrapotassium pyrophosphate tested above As shown in Test 2 of Table II, corrosion performance deteriorated dramatically with the zinc-based program relative to the organic-based treatment, i.e., an LCS corrosion rate of 55 mpy of the zinc program compared to 8.7 mpy with the organic-based program. It is also to be understood that the preferred embodiment of the present invention, as demonstrated by the Effective Inhibitor Replacement in Tables I and II, above, may be utilized with other inorganic phosphates and/or phosphonates replacing pyrophosphate, e.g., orthophosphate, hexametaphosphate, hydroxyethylidene diphosphonic acid, etc., and other cooling water polymers replacing the sulfonic acrylic copolymer, such as a copolymer of maleic anhydride and diisobutylene, a copolymer of acrylic acid and allyloxyhydroxypropanol, or a copolymer of acrylic acid and acrylamido methylpropane sulfonic acid.

Along those lines, a chlorinated test was conducted using a low molecular weight polyacrylic acid (Polymer B), number average molecular weight of 5900–6100 in place of the sulfonic acrylic copolymer (otherwise, same test conditions as in Table II). Test results are found in Table III.

TABLE III

| Treatment** | Corrosion Rate* (mpy) LCS | ADM | LCS Heat Transfer Corrosion results |
|---|---|---|---|
| 1. 1 ppm pyrophosphate 0.5 ppm Polymer A 1.0 ppm glucoheptonate (sodium salt) | 8.7*** | 3.0*** | + |
| 2. 1 ppm pyrophosphate 0.5 ppm Polymer B 1.0 ppm glucoheptonate (sodium salt) | 2.5 | 2.6 | + |

+ lower corrosion than zinc-based treatment
*Differential corrosion rate determinations
**All treatment dosages are expressed as ppm active concentration
***Average corrosion rate determination of two tests
Note: Tetrapotassium pyrophosphate tested above As the data indicates, the low molecular weight polyacrylic acid tested is also an effective cooling water polymer in this treatment configuration. It is anticipated that other sulfonic acrylic copolymers and polyacrylic acids would also be effective.

Additional testing was conducted in order to demonstrate the efficacy of the present invention under conditions indicative of an Electric Utility Application. Results appear in Table IV.

Test conditions were as follows: 90° F. bulk temperature, 105° F. skin temperature, 2.5 ft/sec flow, 1.3 day retention time, 6 day test period.

The test water contained 35 ppm Ca, 30 ppm Mg, 40 ppm M-alkalinity (all as $CaCO_3$), and 15 ppm $SiO_2$ at a specific conductance of 350 umhos, and a pH of 7.8.

TABLE IV

| Treatment*** | Corrosion Rates, mpy* LCS | SS | Cu:Ni | Cu:Ni Heat Transfer Tube Appearance |
|---|---|---|---|---|
| 0.75 ppm Zn 6 ppm orthophosphate 1.5 ppm tolyltriazole (TTA) 0.5 ppm Polymer A | 0.6 | 0.0 | 0.1 | very slight scattered pitting |
| 0.25 ppm Zn 6 ppm orthophosphate 15 ppm $SiO_2$ (30 ppm total)** 1.0 ppm TTA 0.5 ppm Polymer A | 1.1 | 0.0 | 0.0 | clean |
| 2 ppm glucoheptonate (sodium salt) 6 ppm orthophosphate 1.5 ppm TTA 0.5 ppm Polymer A | 1.0 | 0.0 | 0.9 | clean |
| 10 ppm gluco-heptonate (sodium salt) 6 ppm orthophosphate 1.5 ppm TTA 0.5 ppm Polymer A | 0.0 | 0.0 | 0.0 | clean |

*Differential corrosion rates for low carbon steel (LCS), stainless steel (SS), and copper-nickel (Cu:Ni) metallurgy.
**15 ppm $SiO_2$ naturally occurring in the cooling water and 15 ppm $SiO_2$ added as treatment for a total of 30 ppm $SiO_2$.
Note: Sodium salt of orthophosphate tested.

As indicated in the above results, varying amounts of the glucoheptonate compound provided equivalent mild steel corrosion control relative to treatments containing 0.25 to 0.75 ppm Zn. It is expected that azole compounds other than tolyltriazole, such as benzotriazole and butylbenzotriazole, would also be effective.

The following testing of the phosphate compound and organic acid or water soluble salt thereof without the addition of polymeric component further illustrates the efficacy of the present invention. Test conditions are the same as in Table I.

TABLE V

| Treatment** | Corrosion Rate, mpy* LCS | ADM | LCS Heat Transfer Corrosion Results |
|---|---|---|---|
| 1 ppm pyrophosphate 1 ppm glucoheptonate (sodium salt) | 3.2 | 2.5 | + |

*Differential corrosion rate determinations
**All treatment dosages expressed as ppm active concentration
Note: Tetrapotassium pyrophosphate tested above.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

We claim:

1. A method for controlling the corrosion of metals in contact with a cooling water system, which consists essentially of adding to the system from about 0.1 to about 25 parts per million of a substantially zinc-free treatment of (a) an inorganic phosphate compound, (b) glucoheptonic acid or a water soluble salt thereof, and (c) a water soluble polymeric dispersant.

2. The method as recited in claim 1 wherein said water soluble polymeric dispersant is selected from the group consisting of a sulfonic acrylic copolymer and a polyacrylic acid.

3. The method as recited in claim 1 wherein said metals are ferrous-based.

4. The method as recited in claim 1 wherein said water soluble polymeric dispersant is a copolymer of maleic anhydride and diisobutylene, a copolymer of acrylic acid and allyloxyhydroxypropanol, or a copolymer of acrylic acid and acrylamido methylpropane sulfonic acid.

5. The method as recited in claim 1 wherein said phosphate compound is an orthophosphate compound, or a polyphosphate compound.

6. The method as recited in claim 5 wherein said orthophosphate compound is produced by hydrolysis of an organic phosphorous compound.

7. The method as recited in claim 1 wherein said cooling water system is a mill supply environment.

8. The method as recited in claim 2, wherein the sulfonic acrylic copolymer is an acrylic acid/allyl hydroxypropyl sulfonate ether copolymer.

9. In a once-through cooling water system, a method for controlling the corrosion of metals in contact with the system, which consists essentially of introducing into the system from about 0.1 to about 20 parts per million of a substantially zinc-free treatment of (a) an inorganic phosphate compound and (b) glucoheptonic acid or a water soluble salt thereof.

10. The method as recited in claim 9 further comprising a sulfonic acrylic copolymer or a polyacrylic acid.

11. The method as recited in claim 9 wherein said phosphate compound is an orthophosphate compound, or a polyphosphate compound.

12. The method as recited in claim 11 wherein said orthophosphate compound is produced by hydrolysis of an organic phosphorous compound.

13. The method as recited in claim 9 wherein said cooling water system is a mill supply environment.

14. The method as recited in claim 10 wherein the sulfonic acrylic copolymer is an acrylic acid/allyl hydroxypropyl sulfonate ether copolymer.

15. A substantially zinc-free composition for controlling the corrosion of metals in contact with a once-through cooling water system which consists essentially of an inorganic (a) phosphate compound, (b) glucoheptonic acid or a water soluble salt thereof, and (c) a water soluble polymeric dispersant.

* * * * *